United States Patent [19]

Landoni

[11] Patent Number: 4,501,208

[45] Date of Patent: Feb. 26, 1985

[54] PROCESS FOR THE BIDIRECTIONAL FEEDING OF FABRICS IN QUILTING MACHINES, AND A MACHINE UTILIZING THIS PROCESS

[75] Inventor: Giannino Landoni, Fagnano Olona, Italy

[73] Assignee: Meca S.a.s. di Cagnoni Landoni S.C., Cassano Magnago, Italy

[21] Appl. No.: 530,314

[22] Filed: Sep. 8, 1983

[30] Foreign Application Priority Data

Sep. 16, 1982 [IT] Italy ..... 23299 A/82
Sep. 16, 1982 [IT] Italy ..... 23300 A/82

[51] Int. Cl.[3] ..... D05B 21/00
[52] U.S. Cl. ..... 112/118; 112/102
[58] Field of Search ..... 112/117, 118, 119, 102, 112/103

[56] References Cited

U.S. PATENT DOCUMENTS 3,312,184 4/1967 Cash ..... 112/118
3,960,095 6/1976 Story ..... 112/118
4,262,613 4/1981 Landoni ..... 112/118

*Primary Examiner*—Ronald Feldbaum
*Attorney, Agent, or Firm*—Seidel, Gonda & Goldhammer

[57] ABSTRACT

In a quilting machine two or more series of stitches are applied to the product, the product to which stitches have already been applied being moved forward and/or backward, even over a considerable distance, while the exact superposition of the fabrics is maintained.

One embodiment of the machine comprises cylindrical containers (10, 11), in which are disposed the rolls (8, 9) of fabric (2, 3) which are to be quilted. During the backward rotation the cloth is wound over the constant diameter of these containers and in this way the tension applied is also constant.

In another embodiment, return or loose rollers (160, 170) are provided, which take up a portion of fabric (102, 103) already unwound.

The process also permits continuous embroidery, even very complicated embroidery.

8 Claims, 4 Drawing Figures

PROCESS FOR THE BIDIRECTIONAL FEEDING OF FABRICS IN QUILTING MACHINES, AND A MACHINE UTILIZING THIS PROCESS

The present invention relates to a process for the bidirectional feeding of fabrics and paddings for the purpose of applying stitches in accordance with a predetermined design on a continuous product unwinding from rolls. The process is suitable for use in quilting machines and also in machines embroidering fabrics of considerable width. The process according to the invention is therefore particularly suitable for quilting machines but is also applicable to embroidering machines, in which it permits continuous working even with complicated designs and embroidery.

The application of the process will be described with particular reference to a quilting machine, while it is to be understood that its construction can easily be modified to form a continuous embroidering machine.

In quilting machines of known types one or more layers of padding, wadding and the like are unrolled together with one or more bands of fabric, which enclose the padding and are then fastened to the latter by the application of stitches in accordance with predetermined designs. The stitches are applied by means of a plurality of needles moved downwards at predetermined moments of time during the forward movement of the product. In order to produce stitching designs which are not extremely elementary, the quilting machines provide for the lateral displacement of the product by means of a transversely movable carriage suitably synchronized with the forward movement of the fabric. However, notwithstanding the flexibility permitted by such machines, among which for example mention may be made of those forming the object of U.S. Pat. No. 4,106,417 and No. 4,262,613 in the name of the applicants, there is a particular need to be able to effect stitching in accordance with particularly elaborate designs, for which the movements of advance and lateral displacement are not by themselves sufficient.

Various systems have been proposed for the purpose of moving backwards a part of the product which has already been stitched in order to apply additional stitches which are necessary for the more complicated designs, but the quilting machines obtained in this manner did not prove satisfactory, for various reasons.

The solutions proposed are substantially of two types. According to a first solution the entire carriage is mounted so as to be movable not only transversely but also longitudinally, in such a manner as to move backwards a predetermined portion of the product to which to apply subsequently the additional stitches. Although on the one hand this solution at least partly solves the problem of maintaining constant alignment of the two pieces of fabric enclosing the padding, it has the disadvantages of a limited return stroke and of a very complex construction which is difficult to adjust. This obviously has repercussions on the cost of production and does not completely eliminate the disadvantage of non-alignment between the series of stitches applied during the different passes.

According to other known solutions use is made of pairs of rollers or other return mechanisms which act directly on the axis of the fabric, thus simplifying the construction of the machine. The products obtained in this manner are moreover of rather poor quality, as it is extremely difficult to maintain constant tension of the fabric during the return movement and the stitches subsequently applied are offset relative to the previous stitches. It may be recalled that an essential requisite for good quilting (and/or embroidery) is perfect correspondence of the stitches applied in the various steps, and this requires the maintenance of constant tension of the fabrics. The finished product will otherwise have visible misalignment, deformation of the design and other defects which are inacceptable both from the esthetic point of view and from the technical viewpoint.

Finally, other special systems have also been proposed, which permit an extremely limited return movement making them substantially unsuitable for the purpose.

One aim of the present invention is therefore that of providing a process for the feeding of fabric for the application of a plurality of series of stitches to a product, particularly a quilted product, by means of a return movement of a predetermined but also substantially large portion of the previously partially stitched product, this movement being made under constant tension by rewinding part of the unwound product over—in the case of a first embodiment—a cylindrical surface.

In another embodiment the rewinding under constant tension is effected with the aid of return rollers, the shafts of which are movable continuously and in synchronism between a first and a second position. During the normal forward movement of the fabric, that is to say as it unwinds from the roll, the rollers are disposed in a first position, while during the fabric return phase they are moved to a second position, taking back from the machine the necessary amount of fabric without having any effect on the rolls of fabric, the rotation of which is prevented.

The high controlled fabric return capacity has the result that the system, when applied to a multi-needle quilting machine, makes this machine capable of quilting not only with the small and medium-sized designs characteristic of the machine, but also with large panel designs which hitherto were possible only with single-needle machines having long arms. For these applications two important advantages of an economic nature are achieved: it is possible to use many more needles and the quilting is effected continuously from rolls and not with fabrics and padding cut into panels.

Another aim of the invention is to provide a process of the type indicated above, which has characteristics permitting its use for the continuous embroidering of fabrics. At the present time embroidery is effected with the aid of frames of considerable dimensions, working discontinuously. In other words, a rather long strip (15 to 20 meters) or rather great height (1 to 1.5 meters) of fabric to be embroidered is stretched in a very complex vertical frame adapted to apply stitching in accordance with the desired design. This entails a machine of exceptional dimensions for industrially reasonable production, whereas by using the process of the present invention it is possible to obtain continuously, and with a machine of modest dimensions, embroidery of a certain complexity, even if not entirely comparable with the work done by frame type embroidery machines.

Yet another aim of the invention is that of providing a quilting machine which utilizes the process explained above.

The invention will now be described with reference to two preferred, but not limitative, embodiments of quilting machines, with the aid of the accompanying drawings, in which.

Figure 1:
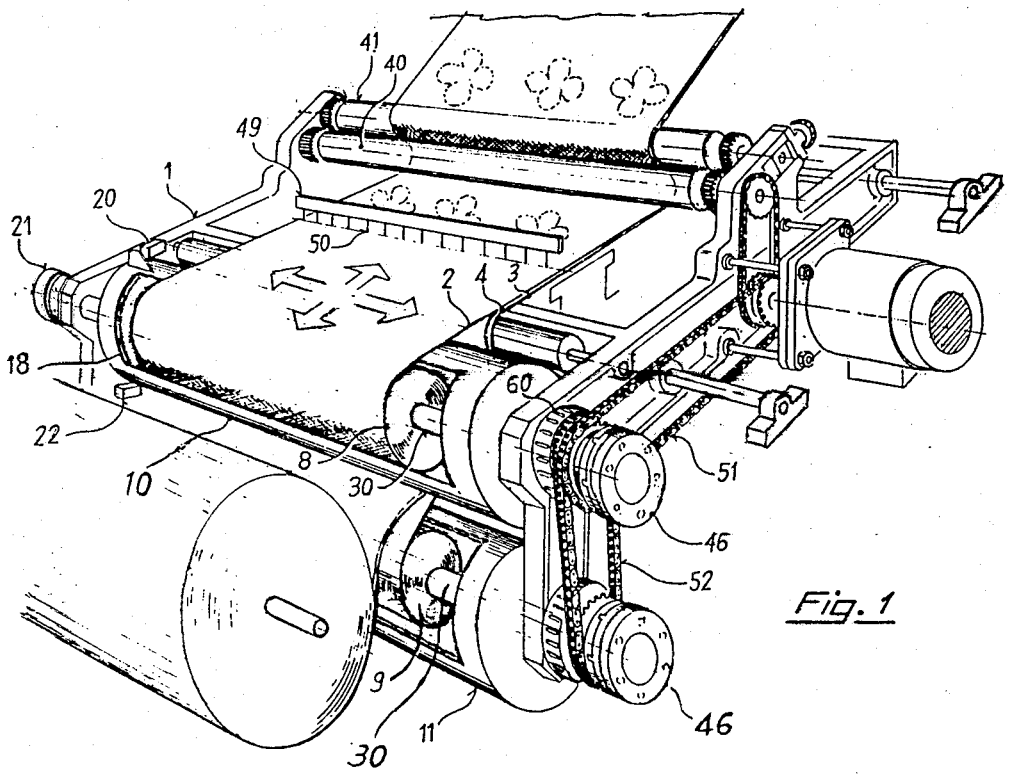
FIG. 1 is a diagrammatical view in perspective of a quilting machine according to the invention.
Figure 2:
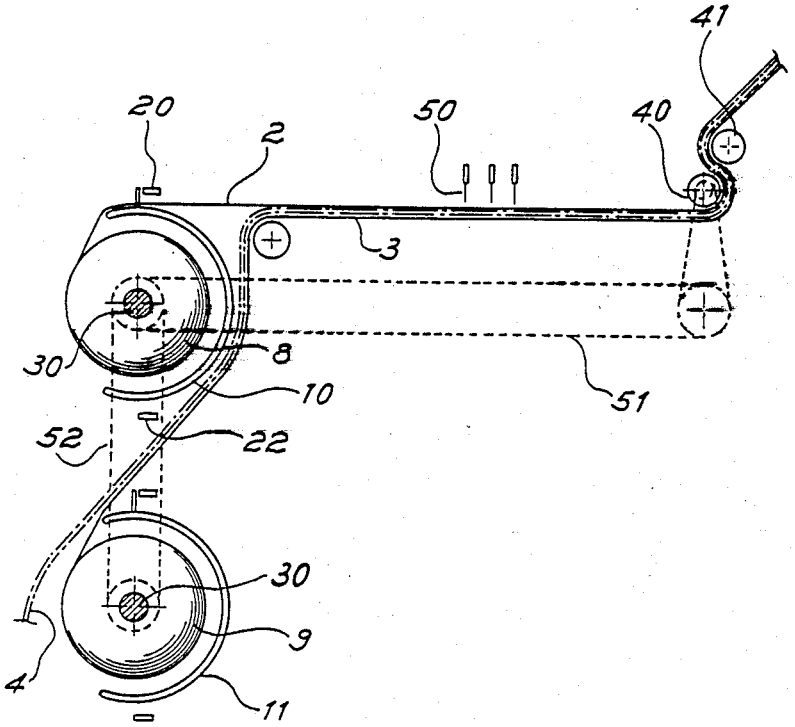
FIG. 2 is a diagrammatical side view which explains the operation of the machine.

Referring to FIGS. 1 and 2, the quilting machine according to the invention comprises a carriage 1 over which is stretched the product to be quilted, which is composed of a band of fabric 2, padding 4, and another band of fabric 3 which constitutes the lining. For the sake of simplicity, a quilted product composed of padding contained between two pieces of fabric will be considered, but the invention is also applicable to the case where the quilted product comprises two or more layers of padding and a corresponding number of pieces of fabric, or else a single piece of fabric without padding.

The pieces of fabric 2 and 3 are unwound from rolls 8 and 9 housed in suitable containers or bushes 10 and 11 respectively. These containers are substantially cylindrical in shape, with a break corresponding to an aperture 18 extending over an arc greater than 90°, but smaller than 180°. The aperture 18 serves for the introduction of the rolls of fabric into the containers and to permit the extraction of the fabric during the unwinding. The description of the structure and operation will be given only for the container 10, since the container 11 for the second roll of fabric (and any other containers) is substantially identical.

In a position corresponding to one edge of the aperture 18 a limit switch 20 and an engaging device 21, which will be described later on, are disposed. At the other end of the aperture 18 a second limit switch 22 is provided. The container is fastened to the carriage and supports the shaft 30 of the roll 8 in a braked manner, so that the unwinding of the fabrics in the forward direction through the action of the drive rollers 40,41 is effected with constant tension and is suitably regulated and synchronized by the braking device 60. A portion of fabric, predetermined by the design programmer, is unwound from the roll 8, stretched over the carriage together with the other components, and during this forward movement the needles 50 apply a first series of stitches in a substantially known manner, the forward movement of the product and the transverse displacements of the carriage being suitably regulated. The forward movement is thereupon stopped and the portion of fabric situated opposite the limit switch 20 is locked by the clutch 21 against the cylindrical surface of the container 10. At the same time the shaft 30 of the roll 8 is locked to the container 10 by means of the electromagnetic clutch 46 and the whole arrangement is transmittingly connected by the transmissions 51 and 52 to the fabric drive rollers 40 and 41. A movement of rotation in the opposite direction to the forward movement is thus started, thereby winding the fabric 2 onto the portion of the cylindrical surface 10 which constitutes the outer surface of the said container. The engagement of the piece of fabric at the clutch 21 and its winding onto a wide cylindrical surface of constant diameter make it possible to maintain accurate tension and mutual positioning of the pieces of fabric 2 and 3 during the return movement (or movements) of the latter. Once the return movement has been completed, that is to say when the fabric has been wound back to the programmed extent and as a maximum as far as the limit switch 22 on the cylindrical surface, the normal forward and/or transverse driving operation is resumed and additional stitches can be applied by the suitably programmed needle-holder bar 49. If necessary, the stitching can also be applied during the return phase, or various forward and return movements can be made as required for the stitching design used.

The maximum length of the portion of fabric moved back, that is to say in other words the portion of product which can be repeatedly stitched, is equal to the development of the outer surface of the container 10 and within wide limits is independent of the diameter of the rolls of fabric and can be selected within a fairly wide range of values. For preference, the diameter of the containers 10 will be selected to be close to a maximum value compatible with the dimensions of the machine and the maximum return length. If the length of return necessary for the quilting should be lower than these values, the return movement can be stopped earlier by using the signals of the design programmer unit or by detecting the length of the return rotation and comparing it with the preprogrammed values.

From the description given above it is clear how the machine according to the invention retains a size substantially equal to that of a normal quilting machine, while however permitting an extremely long return movement of the fabric such as has never been achieved hitherto, this movement being above all very accurate because of the constant tension applied to the fabric, on the one hand by means of a brake during the forward movement, and on the other hand through the engagement of the fabric on the surface of the container 10 during the return movement, thus avoiding detrimental slipping between the fabrics and the padding.

The use of the process according to the invention for the construction of a continuous embroidering machine is substantially identical to the abovedescribed application to quilting. In this case a single roll of cloth will be provided, together with a larger number of needles and preferably a container 10 of substantial diameter in order to enable the embroidery to be done over a considerable portion of fabric.

Figure 3:
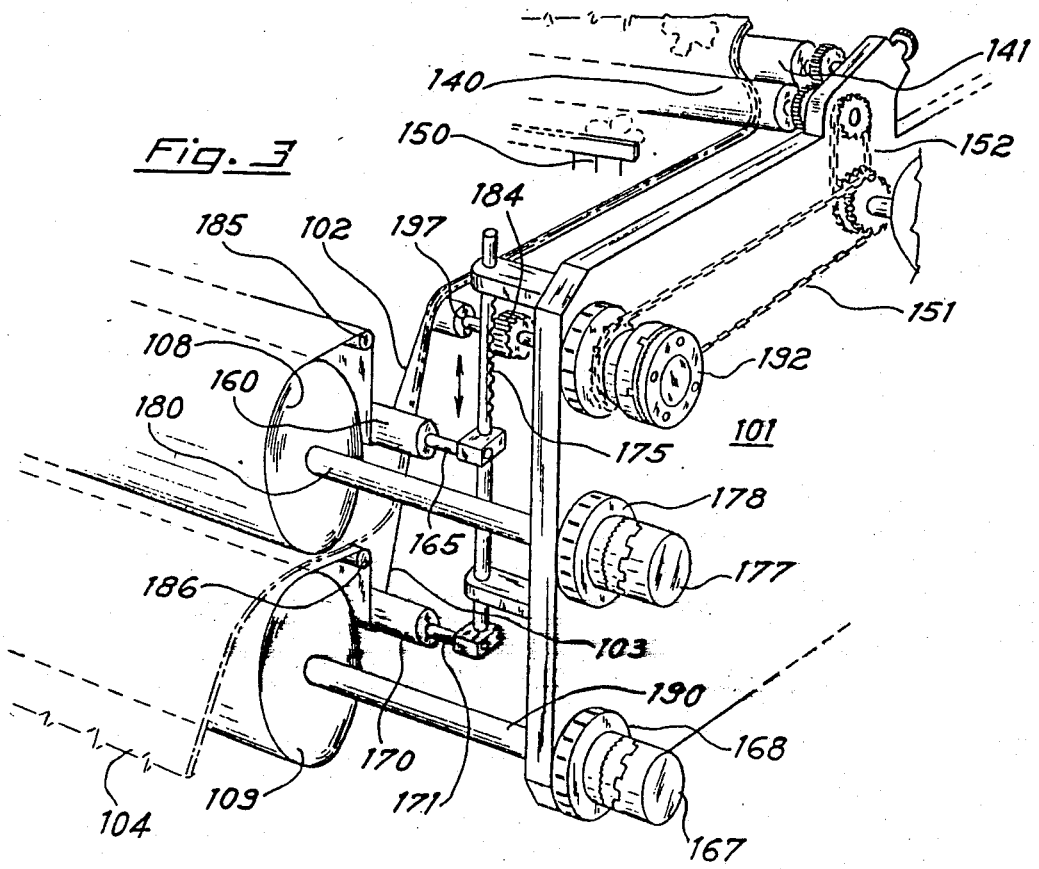
FIG. 3 is a diagrammatical view in perspective of another form of construction of the quilting machine according to the invention.
Figure 4:
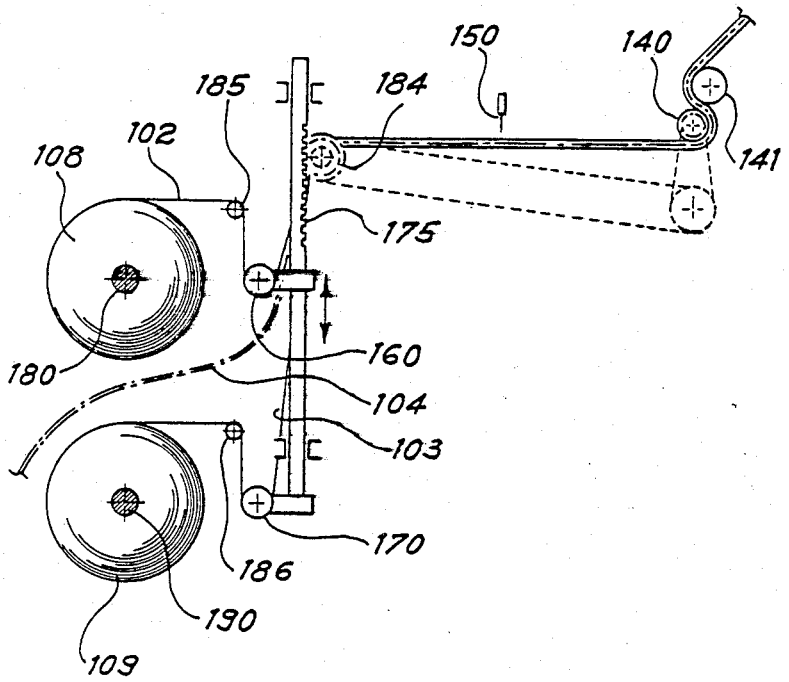
FIG. 4 is a diagrammatical side view which explains the operation of that machine.

Referring to FIGS. 3 and 4, an alternative form of construction of the quilting machine according to the invention comprises a carriage 101 over which is stretched the product to be quilted, consisting of a web of fabric 102, a padding 104, and another web of fabric 103 forming the lining. For the sake of simplicity a quilted product consisting of a padding between two pieces of fabric will be considered, but the invention is also applicable, likewise in this case, to a quilted product comprising one or more layers of padding and a corresponding number of pieces of fabric, or to a single piece of fabric without padding.

The pieces of fabric 102 and 103 are unwound from rolls 108 and 109 supported on respective shafts 180 and 190, which are mounted on the carriage of the machine. The description of the construction and operation will now be given principally in connection with the web of fabric 102, the operation being substantially identical for the other roll.

Along the feed path, which extends between the roll of fabric 108 and the product support surface, are provided a return roller 185 having a fixed shaft and a roller 160 supported by a shaft 165, the band of fabric 102 passing around these rollers. The roller 160 is substantially a movable return roller or dancing roller, and its shaft can be continuously displaced between a first position and a second position, the second position being lower than the first. For the sake of clarity of explanation, the roller is shown in an intermediate position in FIG. 1. The roller 160 is movable along a rack 165 meshing with a pinion 184 mounted on a shaft 197. With the aid of a friction clutch 192 the shaft 197 can be rotationally connected to the drive rollers 140 and 141 moving the product, the movement of these drive rollers being reversible (in order to move the product back) under the control of a central machine control unit (not shown). The connection is made through the transmission chains 151 and 152, which transmit the movement of the rollers 140, 141 only after the clutch 192 has engaged the shaft 197. The roll of fabric is locked by a clutch 177 and the downward movement of the movable roller 160 takes up the returning fabric, keeping it taut under constant tension.

During the forward movement of the fabric 102 the latter is unwound from the roll 108 under constant tension ensured by the adjustable brake 178, and at the same time a first series of stitches is applied by the needles 150 to the product consisting of the pieces of fabric 102 and 103, between which is enclosed the padding 104. After the product has moved forward a predetermined distance, it is returned at least once under the control of the design programmer, by means of the dancing roller 160. Once the control of the movement of the portion of fabric has been transferred to the dancing roller, the fabric undergoes forward and backward movements of suitable extent and suitable in number for the complexity of the design which is to be reproduced. More precisely, the process provides normal forward movement (unwinding the fabric from the roll), followed by a single backward movement of the fabric and the application of a second series of stitches during this return phase or during the successive forward movement (without the unwinding of fabric from the roll) which prepares the system for the treatment of a further portion of product, solely in the case of simple stitch patterns. More frequently, the application of the stitching following the first series of stitches will comprise a plurality of partial movements forward and backward, under the control of the rollers 140, 141 and transmitted by the dancing roller 160 to the portion of fabric being worked on. The mode of procedure will obviously depend on the type and complexity of the design, the fraction of the surface occupied by the design, its repeat frequency, and the criteria of optimization of the control apparatus. The maximum length of the portion of fabric which can be moved back depends on the maximum range of movement provided for the dancing roller 160. This length is twice the maximum displacement permitted to the roller, so that it is possible to move back very large portions of fabric with the aid of a construction of very limited size (length of the rack).

In the quilting machine illustrated in FIGS. 3 and 4 the second roll of cloth 109 undergoes similar treatment (fixed roller 186 and movable roller 170 mounted a shaft 171) and utilizes the same rack 175. The coupled rollers thus form a kind of vertically movable frame with rigidity for the necessary synchronism. Given compatibility with the dimensions of the machine and the maximum return length, it is also possible to use three (or more) rolls of fabric for multi-layer products.

From the description given above it is obvious that the machine according to the invention has a size substantially equal to that of a normal quilting machine, while nevertheless permitting an exremely long backward movement of the fabric, this movement above all being very accurate because of the constant tension applied to the fabric, on the one hand by means of the brake 178 during the forward movement, and on the other hand through the engagement of the pieces of fabric on the surfaces of the dancing rollers 160, 170 during the backward movement, thus avoiding detrimental slipping between the pieces of fabric and the padding.

When the processes according to the invention are applied to a quilting machine capable of making transverse displacements of the carriage with extreme precision, such as for example the machine described in U.S. Pat. No. 4,262,613, a programmable, electronically controlled quilting machine is obtained which has four degrees of liberty for the movements of the product. This machine permits maximum flexibility of utilization for practically any design of stitching and embroidery, however complex.

The scope of protection of the invention extends to obvious modifications and/or variations of both the process and the machine carrying out the process which are self-evident to specialists in the field concerned.

What I claim is:

1. A process for the bidirectional feeding of fabrics in a quilting machine for the application of stitches to a product comprising at least one web of fabric which is unwound from a roll, which comprises the following phases:

(a) Unwinding a web of fabric (2,3; 102,103) from at least one roll (8,9; 108,109) during the phase of forward movement and applying a first series of stitches to the fabric during this forward movement;

(b) Stopping the movement of the roll (8,9; 108,109) and locking the roll in position;

(c) Moving back at least one time a portion of fabric (2,3;102,103) already stitched on in order to form the product by applying further stitches during this backward movement;

(d) Resuming the normal unwinding of the fabric from the roll after unlocking the latter.

2. A process as claimed in claim 1, wherein during the backward movement of the web (2,3) the latter is secured to a cylindrical surface sector (10,11) onto which it is partly wound during the backward movement.

3. A process as claimed in claim 1, wherein during the backward movement of the web (102,103) the latter is taken up by at least one return roller (160,170) adapted to move transversely between a first and a second position.

4. A quilting machine of the type adapted to apply stitches in accordance with a predetermined design to a product consisting of at least two webs of material (2,3) which are unwound from rolls (8,9) by a drive means, at least one of these webs consisting of cloth, wherein the rolls of cloth (8,9) are housed in cylindrical containers (10,11) which are partly open in order to enable the webs of cloth (2,3) unwound from the rolls to pass out, and wherein means (21) are provided for locking a portion of cloth on the outer cylindrical surface of the containers, means (46, 51, 52) for fastening the containers (10,11) to the shafts (30,30) of the rolls of cloth and connecting the containers to the drive rollers (40,41) for initiating a backward movement of said rollers, said webs and said cylindrical containers.

5. A machine as claimed in claim 4, wherein the said locking means comprise a clutch (21) for locking each piece of cloth (2,3) against the outer surface of the corresponding container (10,11), and wherein the connection means comprise electromagnetic clutches (46) which engage the shafts (30,30) of the containers with a transmission system having a transmission chain (51) connected to the cloth drive rollers (40,41).

6. A quilting machine of the type adapted to apply stitches in accordance with a predetermined design to a product consisting of at least two webs (102, 103) of material which are unwound from rolls (108, 109), at least one of these webs being composed of cloth, wherein for each roll of cloth (108, 109) there is provided a return roller (160,170) around which the cloth passes before reaching the stitching station, the shaft (165,175) of this roller being movable from a first position, in which there is substantially no stock of cloth taken from the roll, to a position in which maximum stock is held, and wherein means (117, 187) are provided for locking the rotation of the cloth, together with means (192, 151, 152) for mechanically connecting the return rollers to the cloth drive rollers (140, 141).

7. A machine as claimed in claim 6, wherein two rolls of cloth (108, 109) and also two return rollers (160, 170) are provided, the latter being connected to a common movable frame by means of a pinion and rack system (184, 175).

8. A machine as claimed in claim 7, wherein the supporting shafts of the rolls of cloth (180,190) are provided with a brake device (178, 168) and with a clutch (177, 167) for locking the rolls, and wherein a shaft (197) is provided which is parallel to the said return rollers and supporting shafts and on which are mounted the pinions (184) for operating the frame, while on the said shaft (197) a clutch (192) is also provided for bidirectional transmission connection to the drive rollers (140, 141) during the controlled backward movement phases.

* * * * *